US010173419B2

(12) United States Patent
Sakurada et al.

(10) Patent No.: US 10,173,419 B2
(45) Date of Patent: Jan. 8, 2019

(54) PRINTING APPARATUS AND PRINTING METHOD

(71) Applicant: SEIKO EPSON CORPORATION, Tokyo (JP)

(72) Inventors: Kazuaki Sakurada, Nagano (JP); Takamitsu Kondo, Nagano (JP); Seigo Momose, Milan (IT); Akira Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/559,583

(22) PCT Filed: Feb. 29, 2016

(86) PCT No.: PCT/JP2016/001079
§ 371 (c)(1),
(2) Date: Sep. 19, 2017

(87) PCT Pub. No.: WO2016/152032
PCT Pub. Date: Sep. 29, 2016

(65) Prior Publication Data

US 2018/0043685 A1 Feb. 15, 2018

(30) Foreign Application Priority Data

Mar. 20, 2015 (JP) ..... 2015-057414

(51) Int. Cl.
*B41J 2/045* (2006.01)
*B41J 2/21* (2006.01)
*B41J 25/308* (2006.01)

(52) U.S. Cl.
CPC ..... *B41J 2/04551* (2013.01); *B41J 2/04556* (2013.01); *B41J 2/04581* (2013.01); *B41J 2/04593* (2013.01); *B41J 2/2128* (2013.01); *B41J 2/2135* (2013.01); *B41J 25/308* (2013.01)

(58) Field of Classification Search
CPC .. B41J 2/175; B41J 2/04581; B41J 2002/033; B41J 2002/022; B41J 2/04593; B41J 2/04556; B41J 2/04508; B41J 2/04551
USPC ..... 347/8, 9, 14, 19
See application file for complete search history.

(56) References Cited

U.S. PATENT DOCUMENTS

| | | | |
|---|---|---|---|
| 2006/0192798 | A1 | 8/2006 | Kuki et al. |
| 2007/0182770 | A1 | 8/2007 | Yoshida et al. |
| 2008/0238959 | A1 | 10/2008 | Kato et al. |
| 2012/0229539 | A1 | 9/2012 | Arazaki |

FOREIGN PATENT DOCUMENTS

| | | | |
|---|---|---|---|
| JP | 2006-239866 | A | 9/2006 |
| JP | 2010-006008 | A | 1/2010 |
| JP | 2013-063573 | A | 4/2013 |

OTHER PUBLICATIONS

The Extended European Search Report for the corresponding European Patent Application No. 16767944.8 dated Nov. 2, 2018.

*Primary Examiner* — Jannelle M Lebron

(57) ABSTRACT

The printing apparatus is provided with a transport mechanism section that transports work, a printing mechanism section that has nozzles, which carry out printing by discharging an ink, as liquid droplets, onto the work transported by the transport mechanism section, and an adjustment section that adjusts a volume per single droplet of the ink discharged from the nozzles on the basis of a separation distance between the nozzles and the work, which is positioned directly below the nozzles.

16 Claims, 7 Drawing Sheets

PRINTING APPARATUS AND PRINTING METHOD

This application is a U.S. national phase application of PCT/JP2016/001079, which claims priority to Japanese Patent Application No. 2015-057414, filed on Mar. 20, 2015. The entire disclosure of Japanese Patent Application No. 2015-057414 is hereby incorporated herein by reference.

TECHNICAL FIELD

The present invention relates to a printing apparatus and a printing method.

BACKGROUND ART

Printing apparatuses that print by applying ink onto a recording medium have been used in the related art (for example, refer to PTL 1). The printing apparatus disclosed in PTL 1 is provided with a transport unit that transports a recording medium, nozzles (an ink jet head) that discharge ink onto the recording medium, which is transported, a fabric thickness detection unit that detects a height of a recording surface of the recording medium transported by the transport unit, and a movement unit that changes the height of the nozzles depending on a height position of the recording surface of the fabric detected by the fabric thickness detection unit.

In such a printing apparatus, for example, in a case of performing printing on recording medium such as a fabric with a comparatively large amount of fluff, a distance between the recording medium and the nozzles is comparatively increased by raising and the nozzles by an amount that is equivalent to the amount of the fluff. As a result of this, it is possible to avoid a circumstance in which the fluff comes into contact with the nozzles.

However, as the distance between the nozzle head and the recording medium is increased, there is a problem in that discharged ink does not land in a desired position on the recording medium. It is thought that the reason for this is that the volume of a single droplet of ink, which is discharged from the nozzles, is extremely small, and therefore, may even be subjected to the effects of a slight aerial current.

In this manner, in printing apparatuses of the related art, there is a problem in that printing precision (printing quality) decreases as a separation distance between the nozzles, and the recording medium is increased.

CITATION LIST

Patent Literature

PTL 1: JP-A-2006-239866

SUMMARY OF INVENTION

Technical Problem

Accordingly, it is an object of the present invention to provide a printing apparatus and a printing method that can perform favorable printing irrespective of the separation distance between nozzles and a recording medium.

Solution to Problem

Such an object can be achieved by the following invention.

APPLICATION EXAMPLE 1

A printing apparatus of the present invention includes a transport section that transports a recording medium, and a printing section that includes nozzles which carry out printing by discharging an ink, as liquid droplets, onto the recording medium transported by the transport section, in which a volume of the ink droplets to be discharged from the nozzles is changed on the basis of a separation distance between the nozzles and the recording medium.

As a result of this, it is possible to perform favorable printing irrespective of the separation distance between nozzles and a recording medium.

APPLICATION EXAMPLE 2

In the printing apparatus of the invention, it is preferable that, in the printing section, the ink is determined in advance so as to be discharged as a plurality of types of liquid droplets with mutually different volumes, there are a plurality of printing modes in which a type of the liquid droplets to be discharged, or a number of types of liquid droplets to be discharged differs depending on the printing mode, and a single printing mode is selected from among the plurality of printing modes.

As a result of this, it is possible to perform favorable printing.

APPLICATION EXAMPLE 3

In the printing apparatus of the invention, it is preferable that the ink is determined in advance so as to be discharged as a first liquid droplet, a second liquid droplet, the volume of which is greater than that of the first liquid droplet, and a third liquid droplet, the volume of which is greater than that of the second liquid droplet, and in which a single mode from among a first mode that discharges the first liquid droplet, the second liquid droplet, and the third liquid droplet, a second mode that discharges the second liquid droplet, and the third liquid droplet, and a third mode that discharges the third liquid droplet only, is selected.

As a result of this, it is possible to perform favorable printing.

APPLICATION EXAMPLE 4

In the printing apparatus of the invention, it is preferable that the printing section respectively discharges the first liquid droplet, the second liquid droplet, and the third liquid droplet multiple times, and, in the first mode, the second mode, and the third mode, total ink amounts per unit area on the recording medium on which each liquid droplet is landed, are the same.

As a result of this, it is possible to perform favorable printing in a substantially equivalent manner in each mode.

APPLICATION EXAMPLE 5

In the printing apparatus of the invention, it is preferable that the ink is determined in advance so as to be discharged as first liquid droplets, and second liquid droplets, the volume of which is greater than that of the first liquid droplets, and in which either a first mode that discharges the first liquid droplets, or a second mode that discharges the second liquid droplets, is selected.

As a result of this, it is possible to perform the selection of each mode with reference to a threshold value.

APPLICATION EXAMPLE 6

In the printing apparatus of the invention, it is preferable that the printing section respectively discharges the first liquid droplets and the second liquid droplets multiple times, and, in the first mode and the second mode, total ink amounts per unit area on the recording medium on which each liquid droplet is landed, are the same.

As a result of this, it is possible to perform favorable printing.

APPLICATION EXAMPLE 7

It is preferable that the printing apparatus of the invention further includes a storage section in which a threshold value, which acts as a reference for selecting each mode, is stored, and a single mode of any one of the modes is selected depending on a magnitude relationship between the threshold value and the separation distance.

As a result of this, it is possible to perform favorable printing.

APPLICATION EXAMPLE 8

In the printing apparatus of the invention, it is preferable that the printing section discharges the ink of a plurality of mutually different types of color, and the threshold value is stored for each color of the ink.

As a result of this, it is possible to set the threshold value by taking a difference in physical properties due to differences in ink color into consideration.

APPLICATION EXAMPLE 9

In the printing apparatus of the invention, it is preferable that the threshold value is set on the basis of physical properties of the ink.

As a result of this, it is possible to set the threshold value more accurately.

APPLICATION EXAMPLE 10

It is preferable that the printing apparatus of the invention further includes a main scanning section that performs relative movement of the printing section and the recording medium in a direction that intersects a transport direction, and the threshold value is set on the basis of a relative movement velocity.

As a result of this, it is possible to set the threshold value more accurately.

APPLICATION EXAMPLE 11

In the printing apparatus of the invention, it is preferable that the threshold value is a value that is obtained empirically by discharging the ink onto the recording medium in advance.

As a result of this, it is possible to set the threshold value more accurately.

APPLICATION EXAMPLE 12

In the printing apparatus of the invention, it is preferable that the printing section includes a piezoelectric body, which deforms as a result of the application of a voltage thereto, and the volume of a single droplet of the ink is adjusted by adjusting the voltage that is applied to the piezoelectric body.

As a result of this, it is possible to adjust the volume per single droplet of the ink.

APPLICATION EXAMPLE 13

It is preferable that the printing apparatus of the invention further includes a detection section that detects the separation distance.

As a result of this, it is possible to detect the separation distance.

APPLICATION EXAMPLE 14

It is preferable that the printing apparatus of the invention further includes an input section that inputs the separation distance.

As a result of this, it is possible to input the separation distance.

APPLICATION EXAMPLE 15

A printing method that performs printing using a printing apparatus including a transport section that transports a recording medium, and a printing section that includes nozzles which carry out printing by discharging an ink, as liquid droplets, onto the recording medium transported by the transport section, in which the method includes changing a volume of the ink droplets to be discharged from the nozzles on the basis of a separation distance between the recording medium and the nozzles.

As a result of this, it is possible to perform favorable printing irrespective of the separation distance between nozzles and a recording medium.

DESCRIPTION OF EMBODIMENTS

Hereinafter, a printing apparatus and a printing apparatus of the invention will be described in detail on the basis of preferred embodiments that are shown in the appended drawings.

First Embodiment

Figure 1:
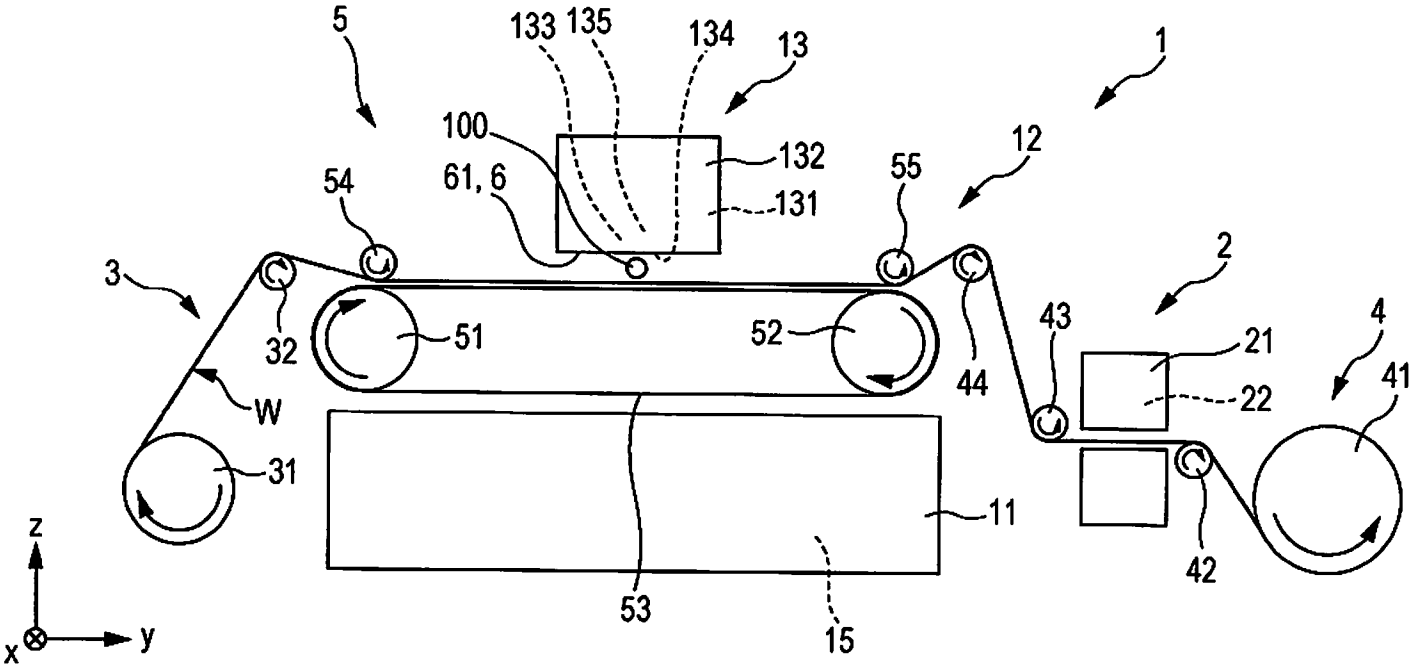
FIG. 1 is a side view that schematically shows a first embodiment of a printing apparatus of the invention.
Figure 2:
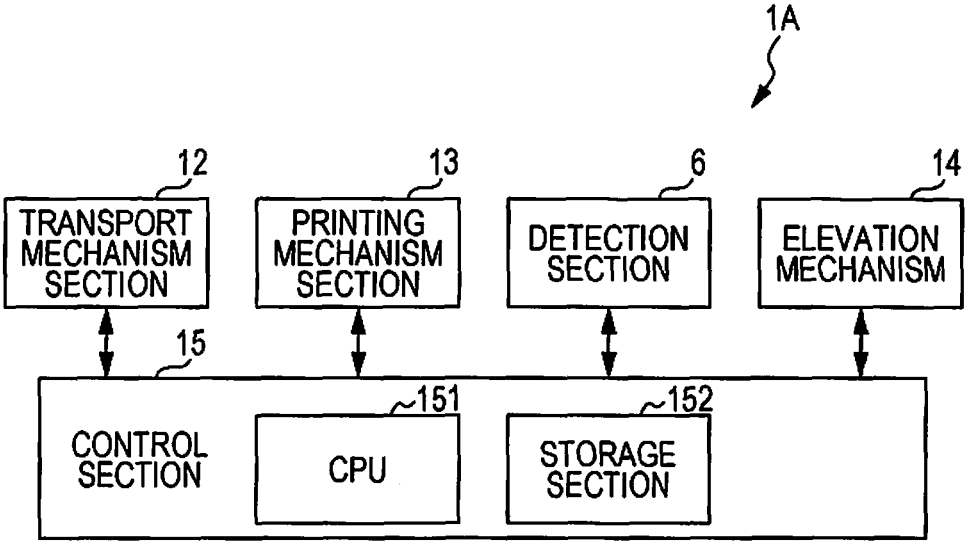
FIG. 2 is a block diagram of the printing apparatus that is shown in FIG. 1.
Figure 3:
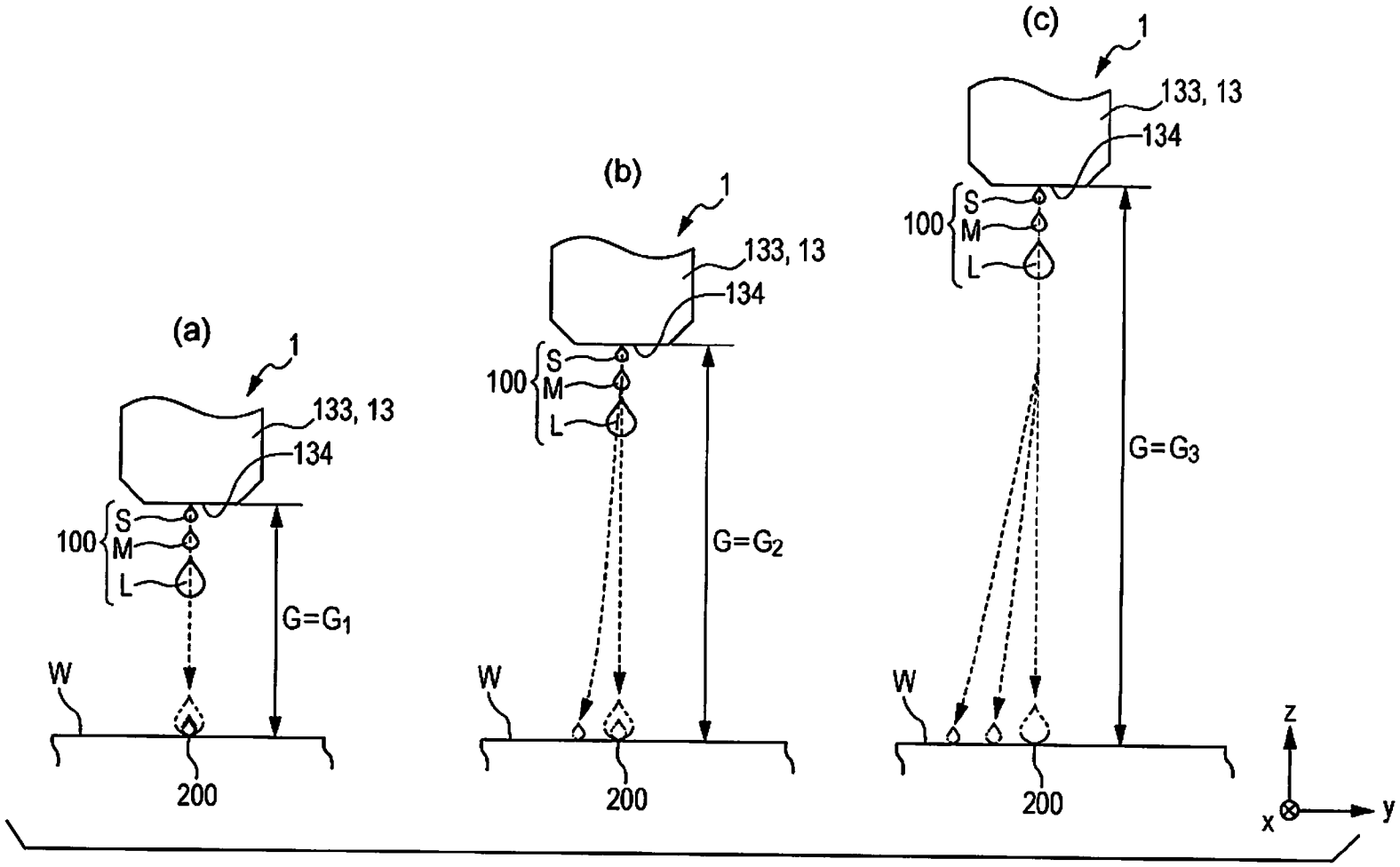
FIG. 3 is a view that shows states in which an ink is discharged in order to obtain threshold values empirically.
Figure 4:
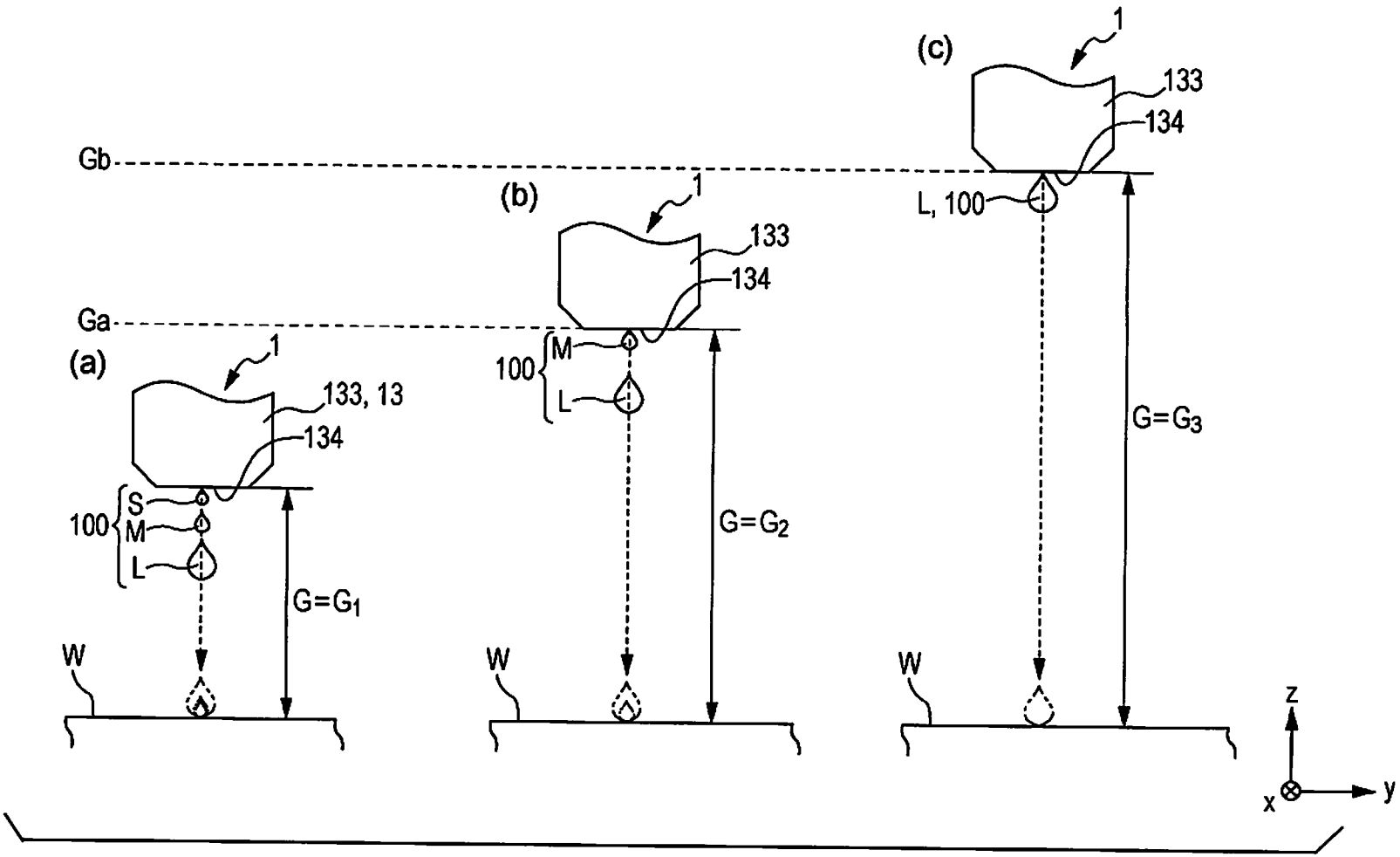
FIG. 4 is a view illustrating a first mode, a second mode and a third mode.
Figure 5A:
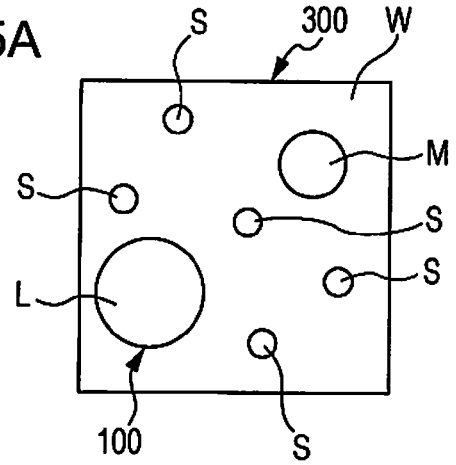
FIG. 5A is a top view of a recording medium on which printing is performed with the first mode.
Figure 5B:
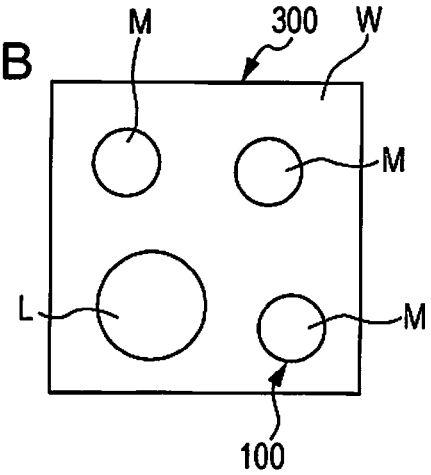
FIG. 5B is a top view of a recording medium on which printing is performed with the second mode.
Figure 5C:
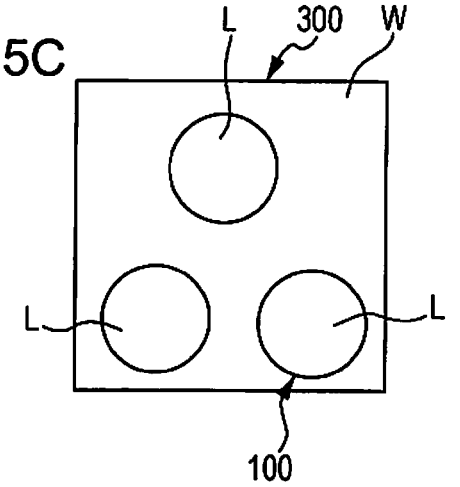
FIG. 5C is a top view of a recording medium on which printing is performed with the third mode.
Figure 6:
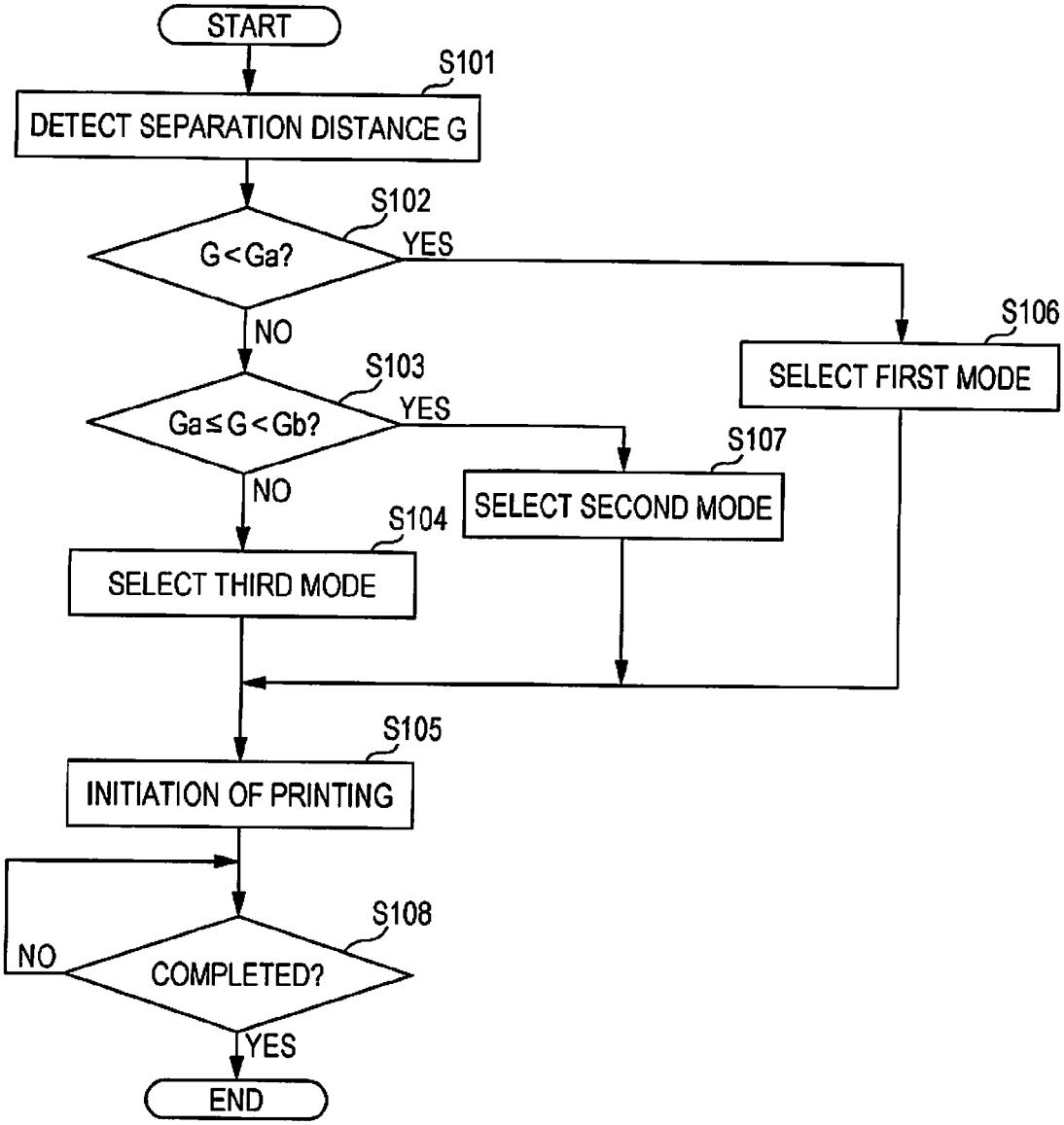
FIG. 6 is a flowchart illustrating a control program of the printing apparatus that is shown in FIG. 1.

FIG. 1 is a side view that schematically shows a first embodiment of a printing apparatus of the invention. FIG. 2 is a block diagram of the printing apparatus that is shown in FIG. 1. FIG. 3 is a view that shows states in which an ink is discharged in order to obtain threshold values empirically. FIG. 4 is a view illustrating a first mode, a second mode, and a third mode. FIGS. 5A to 5C are top views of recording media on which a first mode, a second mode and a third mode are respectively performed. FIG. 6 is a flowchart illustrating a control program of the printing apparatus that is shown in FIG. 1.

Additionally, hereinafter, in FIGS. 1, 3 and 4 (the same applies to FIG. 7), an x axis, a y axis, and a z axis are shown as three axes, which mutually intersect one another. The x axis is an axis along a direction (a width (depth) direction of the printing apparatus) in the horizontal direction, the y axis is an axis along direction (a longitudinal direction of the printing apparatus), which is a horizontal direction, and is perpendicular to the x axis, and the z axis is an axis along a vertical direction (an up-down direction). In addition, a leading end section of each arrow that is shown in the drawings is set as a "positive side (+ side)", and a base end side is set as a "negative side (– side)". In addition, the upper sides in FIGS. 1, 3 and 4 (the same applies to FIG. 7) will be referred to as the "top (upper regions)", and lower sides thereof will be referred to as the "bottom (lower regions)".

As shown in FIGS. 1 and 2, a printing apparatus 1 executes a printing method of the invention, and is provided with a machine platform 11, a transport mechanism section (a transport section) 12 that transports work W, as a recording medium, a printing mechanism section (a printing section) 13 that carries out printing by applying an ink 100 to the work W, a drying section 2 that dries the ink 100 on the work W, a detection section 6, and an elevation mechanism 14.

In the present embodiment, a direction that is orthogonal to a transport direction, in which the work W is transported, is an x axis direction, a direction that is parallel to the transport direction is a y axis direction, and a direction that is orthogonal to the x axis direction and the y axis direction is a z axis direction.

The transport mechanism section 12 is provided with a reel-out device 3 that reels out the longitudinal work W, which is wound around in roll shape, a winding device 4 that winds the work W, on which printing is finished, a support device 5 that is installed on the machine platform 11, and that supports the work W during printing.

The reel-out device 3 is installed on an upstream side of the machine platform 11 in a feed direction of the work W (the y axis direction). The reel-out device 3 includes a feed-out roller (a reel-out reel) 31 around which the work W is wound in roll shape, and that feeds the work W out, and a tensioner 32 that generates tension in the work W between the feed-out roller 31 and the support device 5. A motor (not illustrated in the drawings) is connected to the feed-out roller 31, and the feed-out roller 31 can rotate as a result of the action of the motor.

Additionally, as the work W, it is possible to use a thin film recording medium that has an ink-absorbing property, or a thin film recording medium that has a non-ink-absorbing property. In a case of the former, for example, examples include normal paper, wood free paper, special purpose paper for ink jet recording such as glossy paper, and in addition to the above, a woven fabric, or the like. In a case of the latter, for example, examples include a plastic film on which a surface treatment for ink jet printing has not been performed (that is, on which an ink-absorbing layer is not formed), a recording medium in which a plastic is coated onto, or in which a plastic film is bonded to a base material such as a paper. The corresponding plastic is not particularly limited, and for example, examples thereof include polyvinyl chloride, polyethylene terephthalate, polycarbonate, polystyrene, polyurethane, polyethylene, and polypropylene.

The winding device 4 is installed on a downstream side of the machine platform 11 in a feed direction of the work W (the y axis direction) with respect to the reel-out device 3. The winding device 4 includes a winding roller (a winding reel) 41 onto which the work W is wound in roll shape, and tensioners 42, 43 and 44 that generate tension in the work W between the winding roller 41 and the support device 5. A motor (not illustrated in the drawings) is connected to the winding roller 41, and the winding roller 41 can rotate as a result of the action of the motor. The tensioners 42, 43 and 44 are respectively disposed in this order at intervals in a direction that becomes separated from the winding roller 41.

The support device 5 is disposed between the reel-out device 3 and the winding device 4. The support device 5 includes a main driving roller 51 and a driven roller 52, which are disposed separated from one another in the y axis direction, an endless belt 53, which is stretched between the main driving roller 51 and the driven roller 52, and which supports the work W on an upper surface (a support surface) thereof, and tensioners 54 and 55 that generate tension in the work W between the main driving roller 51 and the driven roller 52.

A motor (not illustrated in the drawings) is connected to the main driving roller 51, and the main driving roller 51 can rotate as a result of the action of the motor. In addition, a rotational force of the main driving roller 51 is transmitted to the driven roller 52 via the endless belt 53, and the driven roller 52 can rotate in an interlocked manner with the main driving roller 51.

The endless belt 53 is a belt on which an adhesive layer, which has an adhesive property, is formed on a surface of a front side thereof. A portion of the work W is adhered to and fixed to the adhesive layer, and the work W is transported in the y axis direction. Further, printing is carried out on the work W during the transport. In addition, after the printing has been carried out, the work W peels away from the endless belt 53.

In the same manner as the main driving roller 51 and the driven roller 52, the tensioners 54 and 55 are disposed separated from one another in the y axis direction.

It is possible to interpose the work W between the tensioner 54 and the main driving roller 51 on the endless belt 53, and it is possible to interpose the work W between the tensioner 55 and the driven roller 52 on the endless belt 53. As a result of this, the work W, in which tension is generated by the tensioners 54 and 55, is fixed to the endless belt 53 and transported in a state in which the tension is generated. As a result of such a state, in the work W, for example, the generation of wrinkles, or the like, during transport is reduced, and accordingly, in a case in which printing is carried out, and therefore, the printing is accurate and high-quality.

The printing mechanism section 13 is provided with a carriage unit 132, which has a plurality of ink jet heads 131 that perform recording through printing by discharging the ink 100 onto the work W, and an X axis table (a main scanning section) that supports the carriage unit 132 in a manner in which the carriage unit 132 is capable of moving in the x axis direction. Each ink jet head 131 is respectively provided with, for example, a head main body, in which an internal head flow channel, an inner section of which is filled with the ink 100, is formed, and a nozzle plate that has multiple nozzles 133, which have an opening.

A piezo piezoelectric element 135 (a piezoelectric body), is configured in the head main body to correspond to each discharge nozzle, and when a voltage is applied to the piezo piezoelectric element 135, the ink 100 is discharged from a nozzle 133 as liquid droplets.

Additionally, in a state in which the ink 100 is not being discharged, the ink jet heads 131 stand by in a position (a stand-by position) that is shifted from the work W (the endless belt 53) when viewed from the z axis direction.

In the printing apparatus 1, the work W, which is reeled out by the reel-out device 3, is intermittently fed (sub-scanned) in the y axis direction in a fixed state of being adhered to and fixed to the endless belt 53, and the ink 100 is discharged from the ink jet heads 131 onto the work W in the fixed state, while the carriage unit 132 is reciprocated (main scanned) in the x axis direction. It is possible to perform the above-mentioned actions until printing is completed, and an image pattern is formed on the work W. Additionally, the image pattern may be an image pattern that results from polychromatic printing (color printing), or may be an image pattern that results from monochromatic printing.

The ink 100 contains a dye or a pigment, as a coloring agent, in water, as a solvent, and for example, there are four colors of cyan (C), magenta (M), yellow (Y) and black (K). Further, the ink 100 of each color is respectively discharged from the ink jet heads 131.

The elevation mechanism 14, which is shown in FIGS. 1 and 2 can adjust the height of the ink jet heads 131. The elevation mechanism 14 can, for example, be set to a configuration that includes a motor, a ball screw and a linear guide. In addition, the motor is equipped with an encoder. It is possible to detect the height of the ink jet head 131 on the basis of a rotational amount that is detected by the encoder. Such an elevation mechanism 14 is also electrically connected to a control section 15.

In a case of performing printing on a fabric, or the like, in which the fluff is comparatively long using the printing apparatus 1, in order to prevent a circumstance in which the fluff comes into contact with the ink jet heads 131, it is necessary to secure a relatively large separation distance G. For example, as shown in part (a) of FIG. 3, in a case in which the work W is a material in which the fluff is comparatively short, it is possible to perform printing with a separation distance $G_1$, which is a comparatively small separation distance G. As shown in part (c) of FIG. 3, in a case in which the work W is a material in which the fluff is comparatively long, it is necessary to perform printing with a separation distance $G_3$, which is comparatively large. In addition, as shown part (b) of in FIG. 3, in a case of a material, which has fluff of a length that is between that of the fluff that is shown in part (a) of FIG. 3 and that of the fluff that is shown in part (c) of FIG. 3, it is necessary to perform printing with a separation distance $G_2$, which is larger than the separation distance $G_1$ and smaller than the separation distance $G_3$.

In this manner, using the elevation mechanism 14, it is possible to perform favorable printing depending on a quality of the material of the work W.

As shown in FIG. 1, the drying section 2 is disposed between the support device 5 and the winding roller 41 of the winding device 4, which is on a downstream side of the printing mechanism section 13 in the transport direction of the work W.

The drying section 2 includes a chamber 21, and a coil 22, which is disposed inside the chamber 21. The coil 22 is, for example, configured by a nichrome wire, and is a heating element that heats as a result of power being supplied thereto. Further, it is possible to dry the ink 100 on the work W that is passing through the chamber 21 as a result of heat that is generated by the coil 22.

As shown in FIGS. 1 and 2, the detection section 6 detects an upper surface position of the work W that passes therethrough. The detection section 6 includes a detection surface 61, which is configured by a so-called "reflective photosensor", and which performs the emission and reception of light. Light that is emitted from the detection surface 61 is reflected by an upper surface of the work W, and is incident to the detection surface 61 again. Information including the attenuation of light at this time is transmitted to the control section 15.

As shown in FIG. 2, the control section (an adjustment section) 15 is electrically connected to the transport mechanism section 12, the printing mechanism section 13, the elevation mechanism 14 and the detection section 6, and has a function of respectively controlling the actions of the above-mentioned components. In addition, the control section 15 includes a Central Processing Unit (CPU) 151, and a storage section 152.

The CPU 151 executes programs for various processes such as a printing process such as that mentioned above. In addition, the CPU 151 can calculate the upper surface position of the work W from the attenuation. Further, it is possible to calculate the separation distance G between the work W and a nozzle surface 134, which is a surface that is on a lower side of the nozzles 133 on the basis of the upper surface position of the work W and the height of the ink jet heads 131, which is transmitted from the encoder of the elevation mechanism 14.

In addition, the CPU 151 can adjust the volume per single droplet of the ink 100 by adjusting the voltage that is applied to the piezo piezoelectric elements 135. In the present embodiment, the printing apparatus 1 can discharge the ink 100 as liquid droplets of three sizes, the volumes of one droplet of which are mutually different. This will be described in detail later.

The method with which the volume per single droplet of the ink 100 is adjusted may be a method other than that of a piezo technique ink jet head such as this, and for example, it is possible to adjust the volume per single droplet of the ink 100 by changing a heat emission amount in a case of a bubble technique ink jet head, which discharges ink droplets using heat energy.

The storage section 152, for example, includes Electrically Erasable Programmable Read-Only Memory (EEPROM), which is a type of non-volatile semiconductor memory, or the like, and can store various programs, or the like.

Meanwhile, as shown in FIG. 3, in the printing apparatus 1, the ink 100 is determined in advance so as to be discharged as the liquid droplets of three sizes, the volumes of one droplet of which are mutually different. Hereinafter, among the liquid droplets of three sizes, the liquid droplets with the smallest volume will be referred to as "liquid droplets S", the liquid droplets with the largest volume will be referred to as "liquid droplets L", and the liquid droplets with a volume between the above-mentioned two types of liquid droplet will be referred to as "liquid droplets M". In addition, hereinafter, description will be given focusing on a single color of cyan (C), magenta (M), yellow (Y) and black (K).

In the printing apparatus 1, as the separation distance G is increased, it becomes more difficult to land the liquid droplets with a small volume (mass) in a location 200 directly below the nozzles 133. It is thought that this phenomenon arises since it is easy for the liquid droplets with a small volume to be subjected to the effects of aerial currents.

As shown in part (a) of FIG. 3, in a case in which the separation distance G is the comparatively small separation distance $G_1$, it is possible to land the liquid droplets S, the liquid droplets M and the liquid droplets L in the location 200. In contrast to this, as shown in part (b) of FIG. 3, in a case in which the separation distance G is the separation distance $G_2$, which is larger than the separation distance $G_1$, although the liquid droplets M and the liquid droplets L land in the location 200, the liquid droplets S land in a position that is shifted from the location 200. Furthermore, as shown in part (c) of FIG. 3, in a case in which the separation distance G is the separation distance $G_3$, which is larger than the separation distance $G_2$, although the liquid droplets L land in the location 200, the liquid droplets S, and also the liquid droplets M land in a position that is shifted from the location 200.

As a result of shifting of the landing positions of the liquid droplets S and the liquid droplets M such as that mentioned above, colors appear blurred, and the like, on a work W, upon which printing has been finished, and the printing precision is reduced as a result, but the present invention has a configuration that is effective in preventing this. Hereinafter, this configuration will be described.

The printing apparatus 1 has a first mode, a second mode and a third mode, and an optimum mode is selected depending on the separation distance G.

As shown in part (a) of FIG. 3 and part (a) of FIG. 4, the first mode is a mode that performs printing using all of the liquid droplets S, the liquid droplets M and the liquid droplets L. Since the first mode performs printing using all of the liquid droplets S, the liquid droplets M and the liquid droplets L, the first mode is a mode that can perform the most favorable printing.

As shown in part (b) of FIG. 4, the second mode is a mode that performs printing using the liquid droplets M and the liquid droplets L without using the liquid droplets S. As shown in part (b) of FIG. 3, the second mode is a mode that is selected in a case in which the separation distance G is large enough for the liquid droplets S to become shifted from the location 200. According to the second mode, since the second mode is originally intended to avoid performing printing using the liquid droplets S, it is possible to reliably prevent a circumstance in which the liquid droplets S land in a position that is shifted from the location 200. Accordingly, it is possible to reliably prevent a reduction in the printing precision as a result of the liquid droplets S landing in a position that is shifted from the location 200.

As shown in part (c) of FIG. 4, the third mode is a mode that performs printing using the liquid droplets L without using the liquid droplets S and the liquid droplets M. As shown in part (c) of FIG. 3, the third mode is a mode that is selected in a case in which the separation distance G is large enough for the liquid droplets S and the liquid droplets M to become shifted from the location 200. According to the third mode, since the third mode is originally intended to avoid performing printing using the liquid droplets S and the liquid droplets M, it is possible to reliably prevent a circumstance in which the liquid droplets S and the liquid droplets M land in a position that is shifted from the location 200. Accordingly, it is possible to reliably prevent a reduction in the printing precision as a result of the liquid droplets S and the liquid droplets M landing in a position that is shifted from the location 200.

In addition, in the printing apparatus 1, when printing the same printing pattern with each mode, total volumes of each liquid droplet per unit area on the work W, on which each liquid droplet S, M and L is landed, are the same. This feature will be described in a representative manner by extracting predetermined regions 300 in the same printing pattern. Additionally, hereinafter, as an example, the volume per single droplet of the liquid droplets S is set as 5 pL, the volume per single droplet of the liquid droplets M is set as 10 pL, and the volume per single droplet of the liquid droplets L is set as 15 pL.

In a case in which 45 pL if the ink 100 is discharged onto the region 300, in the first mode, for example, it is possible to set the liquid droplets S to 4 droplets, the liquid droplets M to 1 droplet and the liquid droplets L to 1 droplet. In the second mode, for example, it is possible to set the liquid droplets M to 3 droplets and the liquid droplets L to 1 droplet. Further, in the third mode, it is possible to set the liquid droplets L to 3 droplets.

In this manner, in a case of printing the same printing pattern with each mode, as a result of the total discharge amounts of the liquid droplets S, the liquid droplets M and the liquid droplets L on the region 300 being the same, it is possible to effectively prevent or suppress a circumstance in which the shade is changed, or the like, by using the modes. That is, in a case of printing the same printing pattern with each mode, it is possible for the modes to be regarded as the same.

The selection of such a first mode, second mode and third mode is performed with a threshold value Ga and a threshold value Gb of the separation distance G, which are stored in the storage section 152 in advance set as references. The threshold value Ga and the threshold value Gb are respectively values obtained in advance in an empirical manner prior to performing printing.

With respect to the threshold value Ga, for example, the separation distance G is gradually increased while performing printing using the liquid droplets S, the liquid droplets M and the liquid droplets L, and it is possible to set a value at which the liquid droplets S become shifted from the location 200 as the threshold value Ga.

For example, after obtaining the threshold value Ga in the above-mentioned manner, the separation distance G is further increased in a practical sense while continuing printing, and the threshold value Gb is set as a value of the separation distance G at which, in addition to the liquid droplets S, the liquid droplets M also become shifted from the location 200.

In the printing apparatus 1, in a case in which the separation distance G less than the threshold value Ga, printing is performed by selecting the first mode. In a case in which the threshold value Ga less than or equal to the separation distance G less than the threshold value Gb, printing is performed by selecting the second mode. Further, in a case in which the threshold value Gb less than or equal to the separation distance G, printing is performed by selecting the third mode.

In this manner, in the printing apparatus 1, by selecting a mode that can reliably land the ink 100 in the location 200 regardless of the separation distance G, it is possible to reliably prevent a circumstance in which the ink 100 lands in a position that is shifted from the location 200. As a result of this, it is possible to perform favorable printing regardless of the separation distance G.

Next, the actions of the printing apparatus 1 will be described on the basis of the flowchart of FIG. 6.

Firstly, prior to performing printing, the values of the threshold values Ga and Gb are obtained in a practical sense in the above-mentioned manner. An operator disposes the work W on the endless belt 53 (refer to FIG. 1). In this state, in the printing apparatus 1, the separation distance G is detected as a result of the detection section 6 detecting the upper surface position of the work W (Step S101).

Next, in Step S102, it is determined whether or not the separation distance G less than the threshold value Ga. In a case in which it is determined that the separation distance G less than the threshold value Ga in Step S102, the first mode is selected (Step S106).

In a case in which it is determined that the threshold value Ga less than or equal to the separation distance G in Step S102, in Step S103, it is determined whether or not the threshold value Ga less than or equal to the separation distance G less than the threshold value Gb. In a case in which it is determined that the threshold value Ga less than or equal to the separation distance G less than the threshold value Gb in Step S103, the second mode is selected (Step S107).

In a case in which it is determined that the threshold value Gb less than or equal to the separation distance G in Step S103, the third mode is selected (Step S104).

Further, printing is initiated with the mode selected in the above-mentioned manner (Step S105).

Next, in Step S108, it is determined whether or not printing is complete. Step S108 is performed until it is determined that printing is complete. If it is determined that printing is complete in Step S108, printing is finished.

In this manner, the printing apparatus 1 is configured so that a single printing mode is selected from printing modes in which the volume per single droplet of the ink, that is, combination of the liquid droplets S, M, and L, which are discharged, differs, on the basis of the separation distance G. As a result of this, it is possible to effectively prevent a circumstance in which the liquid droplets S and the liquid droplets M land in a position that is shifted from a target location (the location 200). Accordingly, it is possible to effectively prevent or suppress a circumstance in which the printing precision is reduced as the separation distance G is increased.

Second Embodiment

Figure 7:
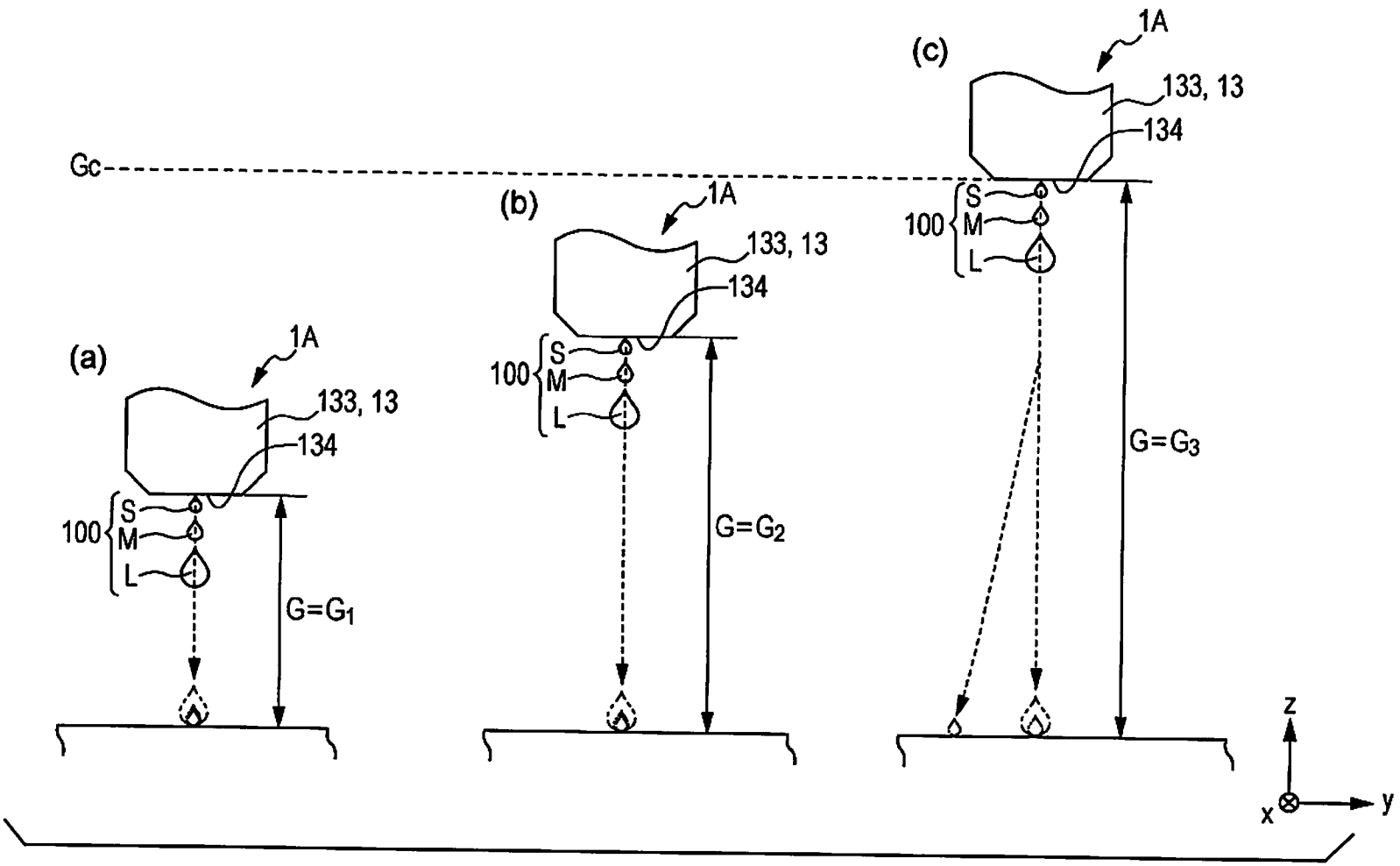
FIG. 7 is a view that shows states in which an ink is discharged in order to obtain threshold values empirically in a second embodiment of a printing apparatus of the invention.

FIG. 7 is a view that shows states in which an ink is discharged in order to obtain threshold values empirically in a second embodiment of a printing apparatus of the invention.

Hereinafter, the second embodiment of the printing apparatus of the invention will be described with reference to the drawing, but description will be given focusing on the differences with the above-mentioned embodiment, and the description of like matters will be omitted.

Apart from the fact that a control program is different the present embodiment is the same as the first embodiment.

In the first embodiment, description is given focusing on a single color of cyan (C), magenta (M), yellow (Y) and black (K), but in the present embodiment, threshold values are respectively obtained in an empirical manner for all of the colors of cyan (C), magenta (M), yellow (Y) and black (K). Further, a single one of the first mode, the second mode, and the third mode is selected for each of the colors of cyan (C), magenta (M), yellow (Y) and black (K). Hereinafter, an example will be described.

In the same manner as the first embodiment, cyan (C), magenta (M), yellow (Y) and black (K) are respectively discharged onto the work W in an empirical manner. As a result of this, as shown in FIG. 3, with respect to cyan (C), magenta (M) and yellow (Y), the liquid droplets S, M and L land in the location 200 when the separation distance G is the separation distance $G_1$, the liquid droplets M and L land in the location 200 when the separation distance G is the separation distance $G_2$, and the liquid droplets L only land in the location 200 when the separation distance G is the separation distance $G_3$.

Meanwhile, with respect to black (K), the liquid droplets S, M and L land in the location 200 when the separation distance G is the separation distance $G_1$, the liquid droplets S, M and L also land in the location 200 when the separation distance G is the separation distance $G_2$, and the liquid droplets M and L land in the location 200 when the separation distance G is the separation distance $G_3$.

As a result of the above-mentioned description, with respect to cyan (C), magenta (M) and yellow (Y), in the same manner as the first embodiment, printing is performed with the first mode when the separation distance G is the separation distance $G_1$, printing is performed with the second mode when the separation distance G is the separation distance $G_2$, and printing is performed with the third mode when the separation distance G is the separation distance $G_3$.

Meanwhile, in the case of black (K), it is possible to perform printing with the first mode when the separation distance G is the separation distance $G_1$ and the separation distance $G_2$, and it is possible to perform printing with the second mode when the separation distance G is the separation distance $G_3$. Therefore, in a printing apparatus 1A, as shown in FIG. 7, a threshold value Gc is set. Further, in the printing apparatus 1A, the first mode is selected when the separation distance G less than the threshold value Gc, and the second mode is selected when the threshold value Gc is less than or equal to the separation distance G.

In this manner, according to the present embodiment, the threshold values are set depending on the type (color) of the ink, and it is possible to select the optimum mode for each type (color) of the ink on the basis of a magnitude relationship between the threshold values thereof and the separation distance G.

In addition, by obtaining the threshold values empirically for each type (color) of the ink, it is possible to set optimum threshold values by taking physical properties (temperature, density, viscosity, or the like, and surface tension), which are different for each type (color) of the ink, into consideration, and therefore, it is possible to select an optimum mode.

In addition, as differences in the type of the ink, in addition to differences in color, for example, there are differences in whether or not the color material is a pigment or a dye, differences in whether or not the color material is a dispersed dye or a reactive dye, differences in the ink set and the like, and the threshold values may be respectively set for each ink set.

Embodiments of the drawings that show the printing apparatus and the printing method of the invention have been described above, but the invention is not limited to these embodiments, and it is possible to substitute each section that configures the printing apparatus for a section that has an arbitrary configuration that is capable of exhibiting the same function. In addition, arbitrary components may be added.

In addition, the printing apparatus of the invention may be a printing apparatus in which two or more arbitrary configurations (features) of each of the above-mentioned embodiments are combined.

Additionally, in each of the above-mentioned embodiments, all of the first liquid droplet, the second liquid droplet, and the third liquid droplet were used in the first mode, but the invention is not limited to this configuration, and only the first liquid droplets may be used, only the second liquid droplets may be used, only the third liquid droplets may be used, only the first liquid droplets and the second liquid droplets may be used, or only the first liquid droplets and the third liquid droplets may be used.

In addition, in each of the above-mentioned embodiments, in the second mode, the second liquid droplet, and the third liquid droplet are used but, the invention is not limited to this configuration, and, for example, only the second liquid droplets may be used, or only the third liquid droplets may be used.

In addition, in each of the above-mentioned embodiments, the adjustment of the separation distance between the upper surface of the recording medium and the nozzles is performed by raising the nozzles, but the invention is not limited to this configuration, and adjustment may be performed by raising the endless belt.

In addition, in each of the above-mentioned embodiments, the value of the separation distance G is detected as a result of the detection section 6 detecting the upper surface position of the work W prior to performing printing, but the invention is not limited to this configuration, and an operator may input a value of the separation distance G using an operation panel or a PC for operation of the printing apparatus prior to performing printing. In addition, during inputting, in addition to inputting a value of the separation distance G, broad values such as "large", "medium" and "small" may be input.

In addition, in each of the above-mentioned embodiments, the value of the separation distance G is detected as a result of the detection section 6 detecting the upper surface position of the work W prior to performing printing, but the invention is not limited to this configuration, and an operator may directly indicate a value of the separation distance G, or a printing mode on the basis of information that is equivalent to a value prior to performing printing.

In addition, in each of the above-mentioned embodiments, the threshold values are set for each type of the ink, but the invention is not limited to this configuration, and in a case in which there are a plurality of printing modes in which the movement velocity of the ink jet head due to the main scanning section differs, the values may be set for each movement velocity thereof. As a result of this, it is possible to set the threshold value more accurately.

REFERENCE SIGNS LIST

1 printing apparatus
1A printing apparatus
2 drying section
21 chamber
22 coil
3 reel-out device
31 feed-out roller
32 tensioner
4 winding device
41 winding roller
42 tensioner
43 tensioner
44 tensioner
5 support device
51 main driving roller
52 driven roller
53 endless belt
54 tensioner
55 tensioner
6 detection section
61 detection surface
11 machine platform
12 transport mechanism section
13 printing mechanism section
131 ink jet head
132 carriage unit
133 nozzles
134 nozzle surface
135 piezo piezoelectric element
14 elevation mechanism
15 control section
151 CPU
152 storage section
100 ink
200 location
300 region
G separation distance
$G_1$ separation distance
$G_2$ separation distance
$G_3$ separation distance
Ga threshold value
Gb threshold value
Gc threshold value
L liquid droplets
M liquid droplets
S liquid droplets
W work

The invention claimed is:

1. A printing apparatus comprising:

a transport section that transports a recording medium; and a printing section that includes nozzles which carry out printing by discharging an ink, as a first liquid droplet, a second liquid droplet, and a third liquid droplet, onto the recording medium transported by the transport section, the second liquid droplet having a volume greater than that of the first liquid droplet, the third liquid droplet having a volume greater than that of the second liquid droplet, wherein a ratio of a first liquid droplet count of the first liquid droplet to be discharged to a unit area, a second liquid droplet count of the second liquid droplet to be discharged to the unit area, and a third liquid droplet count of the third liquid droplet to be discharged to the unit area is changed on the basis of a separation distance between the nozzles and the recording medium.

2. The printing apparatus according to claim 1, wherein the printing section includes a piezoelectric body, which deforms as a result of the application of a voltage thereto, and wherein a volume of a single droplet of the ink is adjusted by adjusting the voltage that is applied to the piezoelectric body.

3. The printing apparatus according to claim 1, further comprising a detection section that detects the separation distance.

4. The printing apparatus according to claim 1,
further comprising an input section that inputs the separation distance.

5. The printing apparatus according to claim 1,
wherein, there are a plurality of printing modes in which the ratio differs depending on the printing mode, and a single printing mode is selected from among the plurality of printing modes.

6. The printing apparatus according to claim 5,
wherein the single printing mode from among a first mode that discharges the first liquid droplet, the second liquid droplet, and the third liquid droplet, a second mode that discharges the second liquid droplet, and the third liquid droplet, and a third mode that discharges the third liquid droplet only, is selected.

7. The printing apparatus according to claim 6,
wherein the printing section respectively discharges the first liquid droplet, the second liquid droplet, and the third liquid droplet multiple times, and
wherein, in the first mode, the second mode, and the third mode, total ink amounts per the unit area on the recording medium on which each liquid droplet is landed, are the same.

8. The printing apparatus according to claim 6,
wherein the printing section does not discharge the first liquid droplet in the second mode, and
the printing section does not discharge the first liquid droplet and the second liquid droplet in the third mode.

9. The printing apparatus according to claim 5,
wherein either a first mode that discharges the first liquid droplets, or a second mode that discharges the second liquid droplets, is selected.

10. The printing apparatus according to claim 9,
wherein the printing section respectively discharges the first liquid droplets and the second liquid droplets multiple times, and
wherein, in the first mode and the second mode, total ink amounts per the unit area on the recording medium on which each liquid droplet is landed, are the same.

11. The printing apparatus according to claim 5,
further comprising a storage section in which a threshold value, which acts as a reference for selecting each mode, is stored,
wherein a single mode of any one of the modes is selected depending on a magnitude relationship between the threshold value and the separation distance.

12. The printing apparatus according to claim 11,
wherein the printing section discharges the ink of a plurality of mutually different types of color, and
wherein the threshold value is stored for each color of the ink.

13. The printing apparatus according to claim 11,
wherein the threshold value is set on the basis of physical properties of the ink.

14. The printing apparatus according to claim 11,
further comprising a main scanning section that performs relative movement of the printing section and the recording medium in a direction that intersects a transport direction,
wherein the threshold value is set on the basis of a relative movement velocity.

15. The printing apparatus according to claim 11,
wherein the threshold value is a value that is obtained empirically by discharging the ink onto the recording medium in advance.

16. A printing method that performs printing using a printing apparatus including a transport section that transports a recording medium, and a printing section that includes nozzles which carry out printing by discharging an ink, as a first liquid droplet, a second liquid droplet and a third liquid droplet, onto the recording medium transported by the transport section, the second liquid droplet having a volume greater than that of the first liquid droplet, the third liquid droplet having a volume greater than that of the second liquid droplet, the method comprising
changing a ratio of a first liquid droplet count of the first liquid droplet to be discharged to a unit area, a second liquid droplet count of the second liquid droplet to be discharged to the unit area, and a third liquid droplet count of the third liquid droplet to be discharged to the unit area on the basis of a separation distance between the recording medium and the nozzles.

* * * * *